US005293722A

United States Patent [19]

Reimann

[11] Patent Number: 5,293,722

[45] Date of Patent: Mar. 15, 1994

[54] CONSTRUCTION UNIT SUITABLE FOR MAKING STAIR STRINGERS

[76] Inventor: Lyall V. Reimann, 7631 Tweedsmuir Avenue, Richmond, British Columbia, Canada, V7A 1L1

[21] Appl. No.: 912,708

[22] Filed: Jul. 13, 1992

[51] Int. Cl.[5] ..... E04F 11/00

[52] U.S. Cl. ..... 52/182; 52/188; 52/190; 52/191; 52/715

[58] Field of Search ..... 52/182, 188, 190, 191, 52/715, 712, 92.2; 248/300, 247, 220.1

[56] References Cited

U.S. PATENT DOCUMENTS

| | | | |
|---|---|---|---|
| 643,773 | 2/1900 | Metcalf | 248/300 |
| 2,859,879 | 11/1958 | Rogers et al. | 248/247 |
| 3,194,527 | 7/1965 | Gruss | 248/300 |
| 3,196,997 | 7/1965 | Hager | 52/182 |
| 3,347,510 | 10/1967 | Buyken | 248/300 |
| 3,458,964 | 8/1969 | Guillians | 248/300 |
| 3,555,750 | 1/1971 | Banse | 248/300 |
| 3,818,672 | 6/1974 | Moore, Sr. . | |
| 3,888,058 | 6/1975 | Ahrens | 52/191 |
| 4,422,270 | 12/1983 | Lapointe et al. | 52/182 |
| 4,583,334 | 4/1986 | Hubbard . | |
| 4,819,391 | 4/1989 | Tassin et al. . | |
| 4,841,690 | 6/1989 | Commins | 52/105 |
| 4,951,434 | 8/1990 | Schmidt | 52/190 |

FOREIGN PATENT DOCUMENTS

| | | | |
|---|---|---|---|
| 8902506 | 3/1989 | World Int. Prop. O. | 52/182 |

*Primary Examiner*—Carl D. Friedman
*Assistant Examiner*—Wynn E. Wood
*Attorney, Agent, or Firm*—Elbie R. De Kock

[57] ABSTRACT

A construction unit (10) which is suitable for use in the fabrication of a stair stringer is provided. In one embodiment, the unit has three side members (12, 14, 16) which form a right triangle. The side member (16) forming the hypotenuse of the right triangle has a flat surface for locating the unit (10) against a flat support surface. The side members (12, 14) forming the other two sides of the right triangle are provided with channels (22) extending along their lengths, each for receiving the edge of a stair tread (28) or stair riser (30) forming sheet therein.

5 Claims, 4 Drawing Sheets

CONSTRUCTION UNIT SUITABLE FOR MAKING STAIR STRINGERS

FIELD OF THE INVENTION

This invention relates to a construction unit which is suitable for applications such as the fabrication of a stair stringer or for supporting a roof beam.

BACKGROUND OF THE INVENTION

Timber is generally used for making stair stringers, usually by cutting triangles out of a 2"×10" or 2"×12" beam to form right-angled recesses for receiving the riser and tread portions of stairs. When stringers are cut out of timber in this fashion, the timber is weakened. Expertise is required to avoid cracks so as not to waste timber. Nevertheless, cracks often do develop in the stringer after the cut-outs have been made. Alternative methods for building stairs have been proposed, such as, for example, a modular carrier for a stair tread as described in U.S. Pat. No. 4,583,334 and a stair bracket, as described in U.S. Pat. No. 4,819,391. However, there is still a need for an effective and inexpensive stair construction unit which is easy to apply and which saves timber and labour costs.

SUMMARY OF THE INVENTION

According to one embodiment of the invention, there is provided a construction unit comprising three side members which form a right triangle, wherein the side member forming the hypotenuse of the right triangle has a flat surface for locating the unit against a flat support surface and the side members forming the other two sides of the right triangle are provided with channels extending along their lengths, each for receiving the edge of a sheet or beam therein. The construction unit may further comprise a reinforcing web extending between at least two of the three side members. In a preferred embodiment, the three side members define a closed triangular area between them and said reinforcing web is co-extensive with said triangular area.

According to another embodiment of the invention, there is provided a construction unit comprising three side members which form a right triangle, the side members having inner surfaces facing towards the inside of the triangle and outer surfaces on the outside of the triangle, and a reinforcing web extending between the inner surfaces of at least two of said side members, wherein the outer surfaces of the side members are flat for locating each of the side members against a flat surface. The reinforcing member is preferably coextensive with an area defined between the inner surfaces of said side members.

According to a further embodiment of the invention, there is provided a construction unit comprising a central web portion in the form of a right triangle provide with a T-flange therearound, the T-flange having three flat outer sides defining a right triangle.

In a particular embodiment, the construction unit comprises a stair construction unit for the fabrication of a stair stringer.

Further objects and advantages of the invention will become apparent from the description of a preferred embodiment of the invention below.

BRIEF DESCRIPTION OF THE DRAWINGS

The invention will now be described, by way of an example, with reference to the accompanying drawings, in which.

DETAILED DESCRIPTION OF PREFERRED EMBODIMENT

Figure 1:
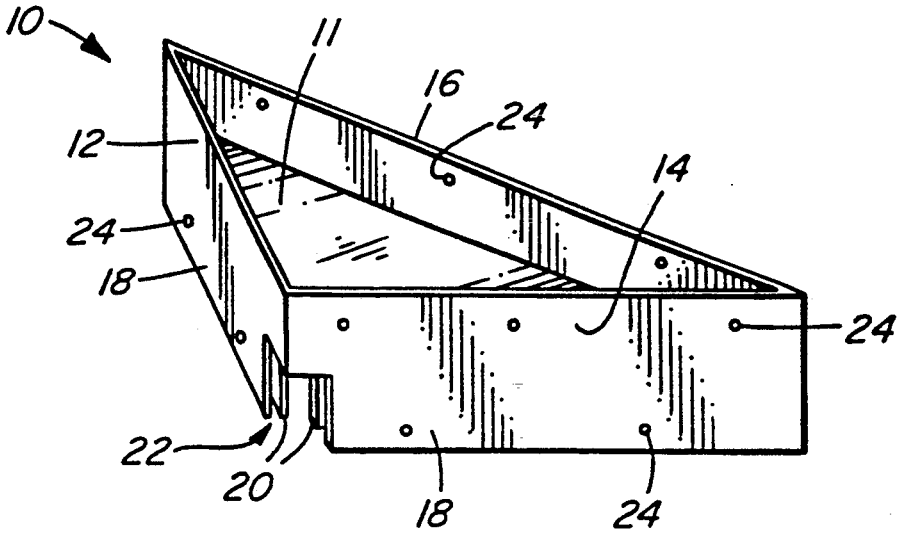
FIG. 1 is a three-dimensional view of a stair construction unit according to the invention, as seen from one side.
Figure 2:
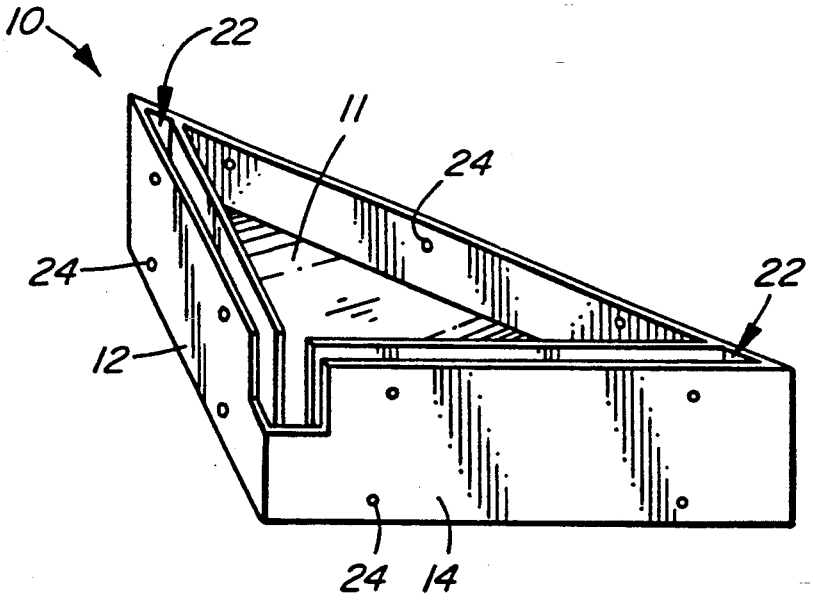
FIG. 2 is a three-dimensional view of the stair construction unit of FIG. 1, as seen from the opposite side.
Figure 3:
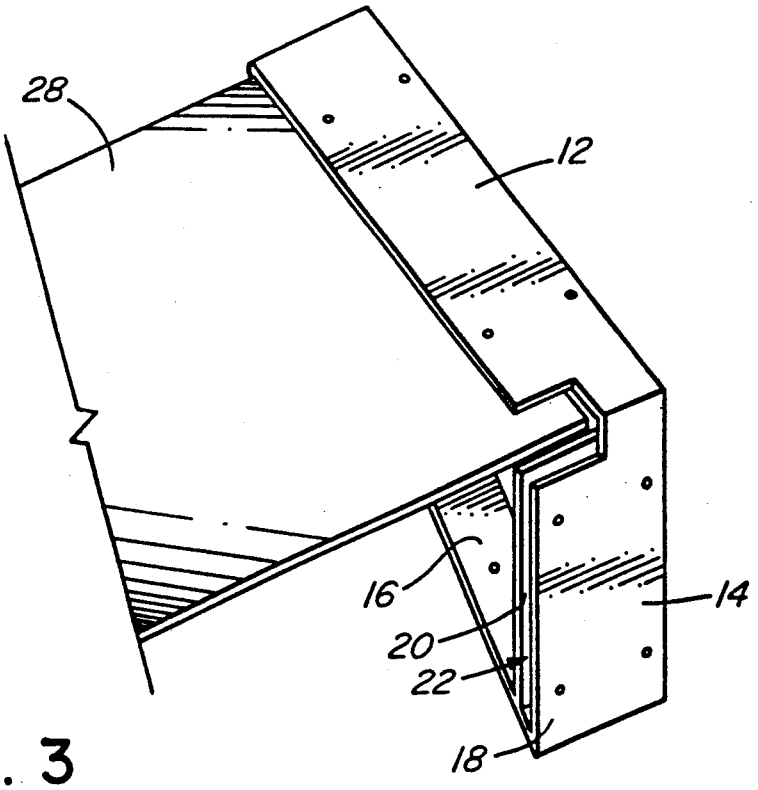
FIG. 3 is a different three-dimensional view of the unit of FIG. 1, showing a sheet or beam forming a stair tread portion inserted in a channel on the unit.
Figure 4:
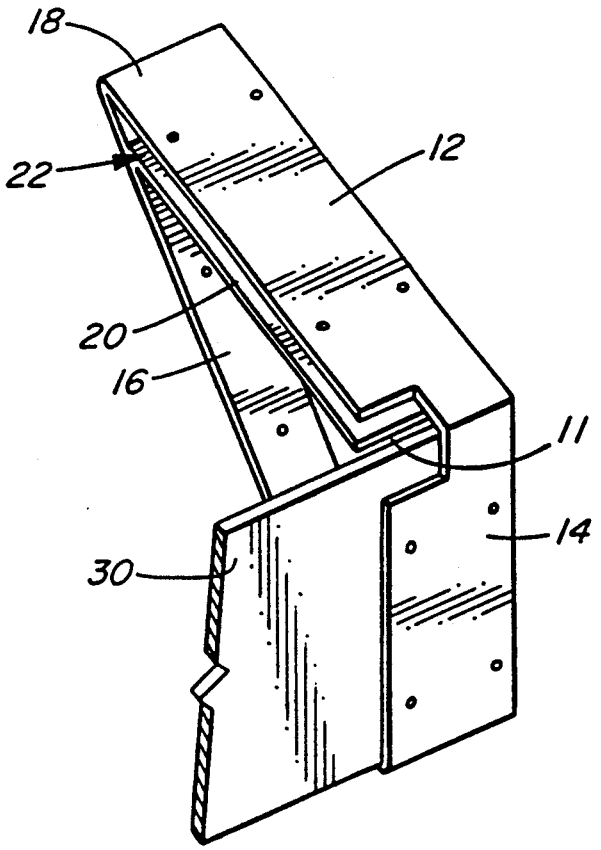
FIG. 4 is a view similar to FIG. 3, showing a sheet or beam forming a stair riser portion inserted in a channel on the unit.

With reference to FIGS. 1 and 2, reference numeral 10 generally indicates a stair construction unit which comprises a central web portion 11 in the form of a right triangle provided with a T-flange therearound, the T-flange having three flat outer surfaces 12, 16 and 18 defining a right triangle. In the present example, the side 12 is longer than the side 14, as can be more clearly seen from FIGS. 3 and 4. The side 12 is the stair tread side and the side 14 is the stair riser side. The side forming the hypotenuse of the right triangle is the rear side of the unit 10. The riser and tread sides 12, 14 are provided with parallel members 18, 20 defining channels 22 therebetween for receiving sheets or beams, as shown in FIGS. 3 and 4, for forming the riser and tread portions of stairs, as will be described in more detail below. Holes 24 are provided in the sides 12, 14, 16 for receiving nails when securing the sheets or beams forming the stair riser and tread portions in position. The unit 10 is moulded from a suitable plastic material.

Figure 5:
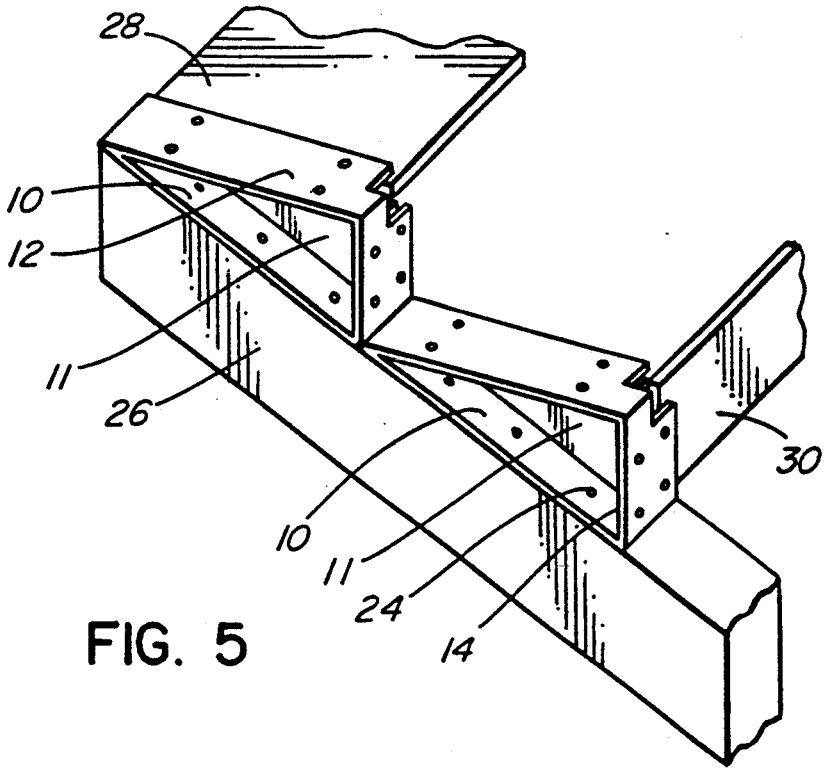
FIG. 5 is a three-dimensional view showing two of the units of FIG. 1 attached to a beam of timber to obtain a stair stringer, showing sheets or beams forming stair tread and riser portions inserted in channels on the construction units.
Figure 6:
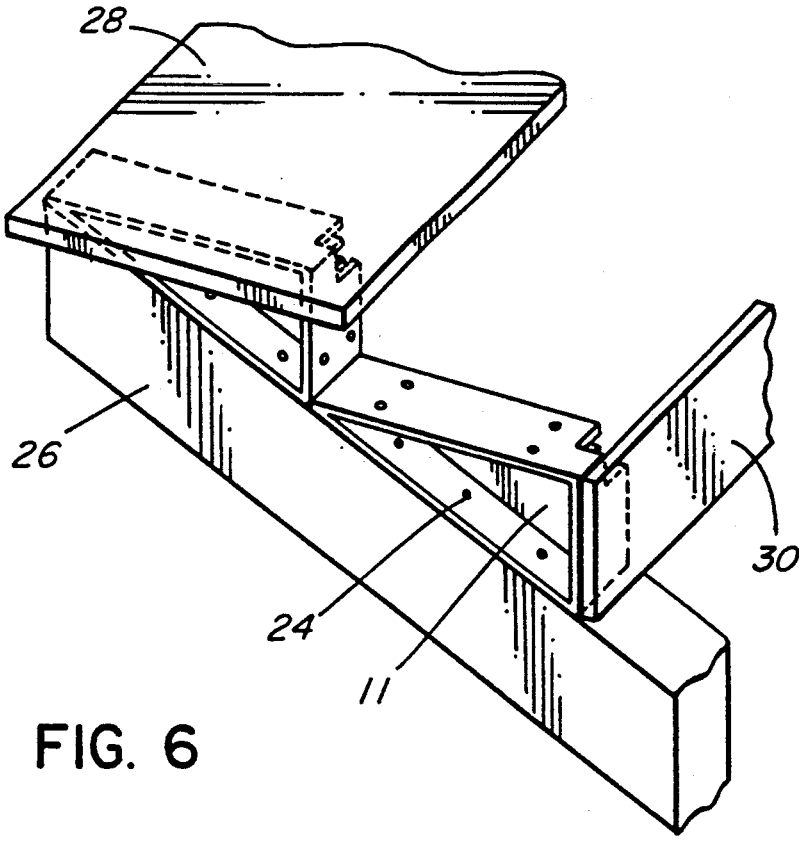
FIG. 6 is a three-dimensional view similar to FIG. 5, but showing the sheets or beams forming the tread and riser portions attached to the outsides of the construction units.

In use, when constructing a staircase, a pair of timber beams 26, only one of which is shown in FIGS. 5 and 6, are provided in spaced parallel relationship to support the sides of a staircase. The beams 26 can be of a size 2"×4" or 2"×6", which is considerably narrower than the beams from which cutouts are traditionally made, thus saving wood and reducing costs. A series of the units 10 are attached to each beam 26, as shown, by means of nails extending through the holes 24 on the sides 16. Once the units 10 are located in place, sheets or beams 28 and 30 forming tread and riser portions of the stairs are located in place. The sheets 28 and 30 can be inserted in the channels 22 as shown in FIG. 5 or they can be located on the outside of the units 10, as shown in FIG. 6. The sheets 28, 30 are attached to the units 10 by means of nails extending through the holes 24. The arrangement is such that the front end of each tread portion 28 is supported by the top edge of its corresponding riser portion 30.

An auxiliary gusset or unit (not shown) similar to the unit 10, but with smaller dimensions, may be provided and utilized as a centre stringer for support when a sheet material such as plywood is used in constructing the stairs. The units 10 may also be curved with longs and shorts for standard curves of a stairway.

The construction unit 10 can be provided in different sizes to accommodate particular staircase requirements. For example, the riser and tread sides 12, 14 may be longer or shorter to provide for the required tread width or riser height in a particular application. The angles between the riser and tread sides 12, 14 and the rear side 16 may also be varied depending on the steepness of the staircase. To provide for a curved stairway, units 10 with wider tread portions may be used on the outside of the curve relative to the inside of the curve. In addition, the unit 10 may be curved to conform with the curved profile of the stairway.

In applications where a relatively thin wood is used for the sheets 28, 30 forming the tread and riser portions, such as a 1" plywood, the sheets 28, 30 are preferably inserted into the channels 22 during construction of a staircase.

Figure 7:
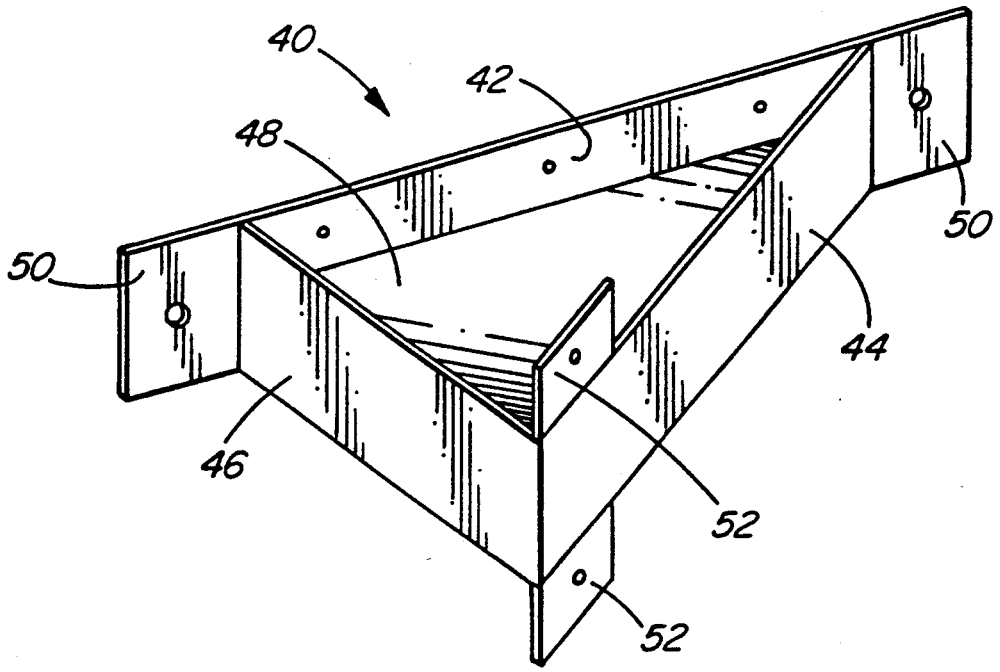
FIG. 7 is a three-dimensional view showing a construction unit according to another embodiment of the invention which is suitable for supporting a roof beam.
Figure 8:
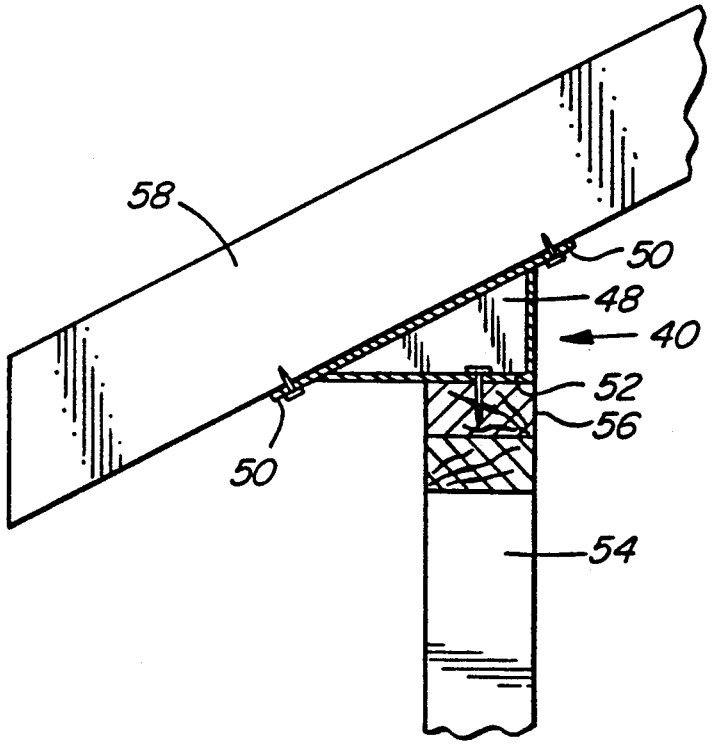
FIG. 8 is a side view showing the unit of FIG. 7 in place on the top of a wall and supporting a roof beam.

Referring to FIGS. 7 and 8, a construction unit 40 according to another embodiment of the invention is shown. The unit 40 comprises a three-sided member in the form of a right triangle which is moulded from a plastic material. The unit 40 has three sides 42, 44 and 46 with a gusset or web portion 48 in between. Lugs 50 are provided at the opposite ends of the side 42, forming the hypotenuse of the triangle, and a pair of transverse lugs 52 are provided on opposite sides of the side 44.

The lugs 52 are used for locating the unit 40 in position on top of a wall 54, through the intermediary of a wall plate 56, in the present example. A roof beam 58 is secured to the unit 40 through the lugs 50, thus supporting the roof beam 58 at the desired angle. The unit 40 replaces the traditional angle blocks which are cut on site to support a roof beam. The angle of the unit 40 may be varied depending on the pitch requirements of a roof.

While only preferred embodiments of the invention have been described herein in detail, the invention is not limited thereby and modifications can be made within the scope of the attached claims.

What is claimed is:

1. A construction unit comprising three side members which form a right triangle, wherein the side member forming the hypotenuse of the right triangle has a flat surface for locating the unit against a flat support surface and the side members forming the other two sides of the right triangle are provided with channels extending along their lengths, each channel for receiving the edge of a sheet or beam therein.

2. The construction unit according to claim 1, further comprising a reinforcing web extending between at least two of the three side members.

3. The construction unit according to claim 2, wherein the three side members define a closed triangular area and said reinforcing web is co-extensive with said triangular area.

4. The construction unit according to claim 3, which is moulded from a synthetic material.

5. A construction unit comprising a central web portion in the form of a right triangle provided with a T-flange around said central web portion, the T-flange having three flat outer sides defining a right triangle, and wherein two of said outer sides, other than the side forming the hypotenuse of the right triangle, are provided with channels extending along their lengths, each channel for receiving the edge of a sheet or beam therein.

* * * * *